US007945968B2

(12) United States Patent
Johnson

(10) Patent No.: US 7,945,968 B2
(45) Date of Patent: May 24, 2011

(54) PROTECTIVE CLOTHING

(76) Inventor: Ricky L. Johnson, Aleppo, PA (US)

( * ) Notice: Subject to any disclaimer, the term of this patent is extended or adjusted under 35 U.S.C. 154(b) by 176 days.

(21) Appl. No.: 12/406,244

(22) Filed: Mar. 18, 2009

(65) Prior Publication Data

US 2010/0235960 A1 Sep. 23, 2010

(51) Int. Cl.
*A41D 13/00* (2006.01)

(52) U.S. Cl. ..... 2/23

(58) Field of Classification Search ..... 2/22, 23, 2/24, 62, 227, 231, 267, 16, 455, 79, 908, 2/911
See application file for complete search history.

(56) References Cited

U.S. PATENT DOCUMENTS 2,568,083 A * 9/1951 Mitchell ..... 2/231
4,561,123 A * 12/1985 Hull ..... 2/23
4,831,666 A 5/1989 Denman
5,611,081 A 3/1997 Torres
5,732,412 A * 3/1998 Holden ..... 2/23
6,347,403 B1 * 2/2002 Wilcox ..... 2/23
6,421,839 B1 * 7/2002 Vo et al. ..... 2/227
6,745,398 B1 6/2004 Hennessey
7,380,283 B1 6/2008 Dumont

* cited by examiner

*Primary Examiner* — Tejash Patel
(74) *Attorney, Agent, or Firm* — Dale J. Ream

(57) ABSTRACT

Protective clothing includes trousers having a leg portion with a distal end, a proximal end, and a knee area that corresponds to a wearer's knee when the trousers are worn by the wearer. Padding is coupled to the trousers and extends adjacent the knee area. A first and second array of fasteners is coupled to the leg portion, the first and second array having an upper end relatively adjacent to the leg portion proximal end and a lower end relatively distant to the leg portion proximal end. The clothing includes an adjustable protective member having a first side and a second side. A first strap extends from the first side of the adjustable protective member and is removably coupled to the first array of fasteners. A second strap extends from the second side of the adjustable protective member and is removably coupled to the second array of fasteners.

14 Claims, 6 Drawing Sheets

PROTECTIVE CLOTHING

BACKGROUND OF THE INVENTION

This invention relates generally to clothing and, more particularly, to protective clothing that provides comfort and protection to the knees of a wearer.

For some tradesmen, much of their daily work requires them to work on their knees. For example, tradesmen such as installers of carpet or other flooring as well as other construction workers spend all or part of their workday on their knees. Working on one's knees, of course, may be uncomfortable, painful, or even lead to serious knee injuries. For example, kneeling on the floor of a construction site may result in contacting a nail, screw, or other sharp object that would inflict injury.

Various devices and designs have been proposed in the art for kneepads and clothing with knee protection devices. Although assumably effective for their intended purposes, the existing devices do not include knee protective devices that are integral to a clothing construction or that are adjustable or removable.

Therefore, it would be desirable to have protective clothing that includes an adjustable protective member integrated into its construction and that may be selectively positioned. Further, it would be desirable to have protective clothing that includes trousers having padding positioned in an area corresponding to a wearer's knees. In addition, it would be desirable to have protective clothing that includes one or more straps for maintaining the protective member at a desired location.

SUMMARY OF THE INVENTION

Protective clothing according to a preferred embodiment of the present invention includes trousers having a leg portion with a distal end, a proximal end, and a knee area that corresponds to a wearer's knee when the trousers are worn by the wearer. Padding is coupled to the trousers and extends adjacent the knee area. A first and second array of fasteners is coupled to the leg portion, the first and second array having an upper end relatively adjacent to the leg portion proximal end and a lower end relatively distant to the leg portion proximal end. The clothing includes an adjustable protective member having a first side and a second side. A first strap extends from the first side of the adjustable protective member and is removably coupled to the first array of fasteners. A second strap extends from the second side of the adjustable protective member and is removably coupled to the second array of fasteners.

Therefore, a general object of this invention is to provide protective clothing that includes a pair of trousers having integrated padding and removable hard-shell knee pads.

A further object of this invention is to provide protective clothing, as aforesaid, in which the knee pads are vertically and horizontally adjustable so as to correspond to the position of a wearer's knees within the trousers.

Yet another object of this invention is to provide protective clothing, as aforesaid, in which the adjustable protective member includes a hard shell to protect a wearer's knee from being punctured by sharp object that may be knelt upon.

A further object of this invention is to provide protective clothing, as aforesaid, in which the integrated padding is constructed of closed cell foam so as to be washable along with the trousers.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Protective clothing will now be described in detail with reference to FIG. 1 through FIG. 6*b* of the accompanying drawings. More particularly, protective clothing 100 of one embodiment includes trousers 110, padding 130, and an adjustable protective member 140.

Figure 1:
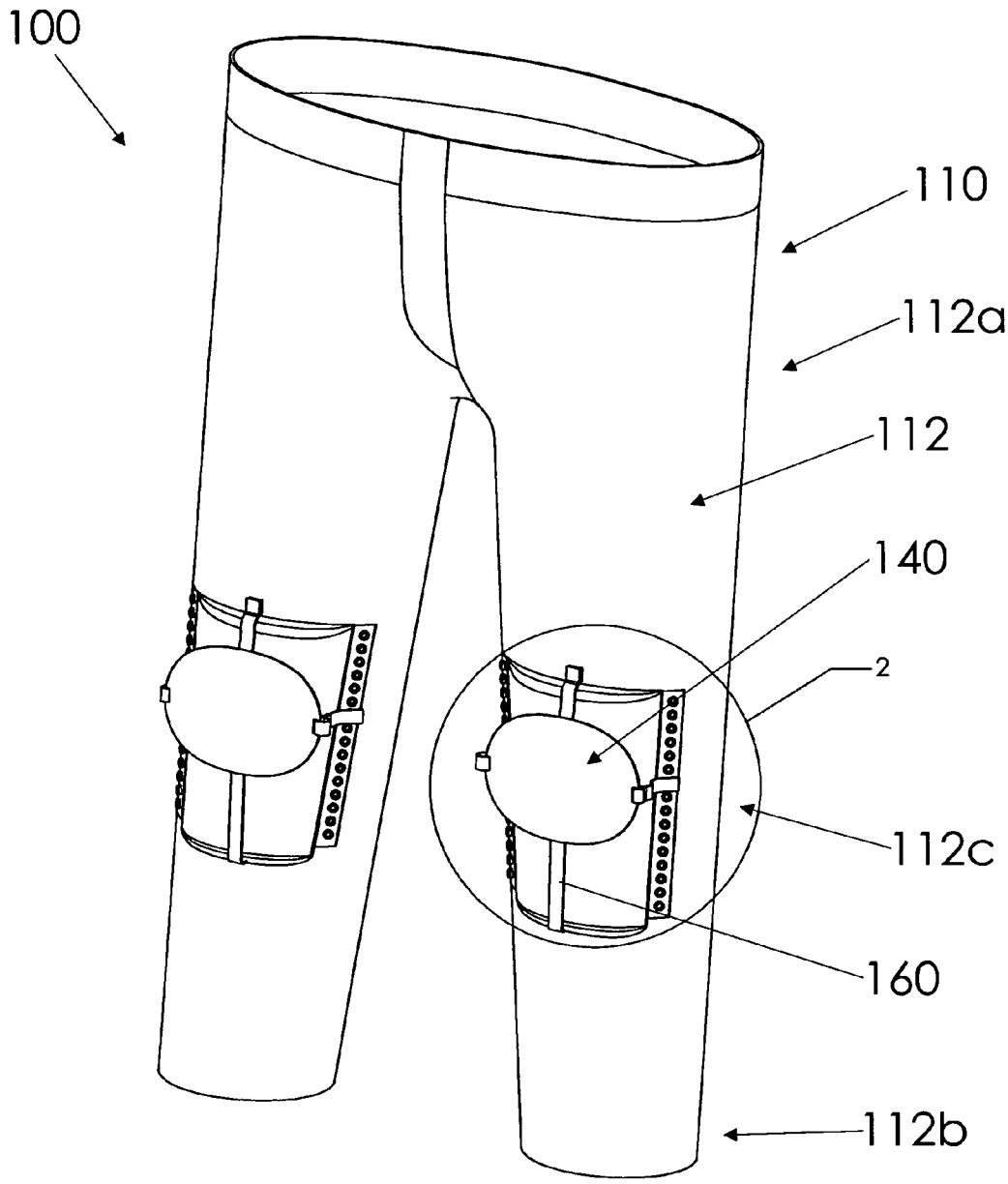
FIG. 1 is a perspective view of protective clothing according to a preferred embodiment of the present invention.

As shown in FIG. 1, the trousers 110 have a leg portion 112 with a proximal end 112*a*, a distal end 112*b*, and a knee area 112*c* that corresponds to a wearer's knee when the trousers 110 are worn by the wearer. The padding 130 (FIG. 6*b*) is coupled to the trousers 110 and extends adjacent the knee area 112*c*. The padding 130 may be sewn into the trousers 110, as shown in FIG. 6*b*, or may be otherwise coupled to the trousers (e.g., through adhesive, fasteners, etc.). It should be appreciated that in some embodiments the padding 130 may be permanently coupled to the trousers 110, and that in other embodiments the padding 130 may be removably coupled to the trousers 110. While closed cell foam is a currently preferred material for the padding 130, other materials would also be suitable, as will be apparent to one of ordinary skill in the art.

Figure 2:
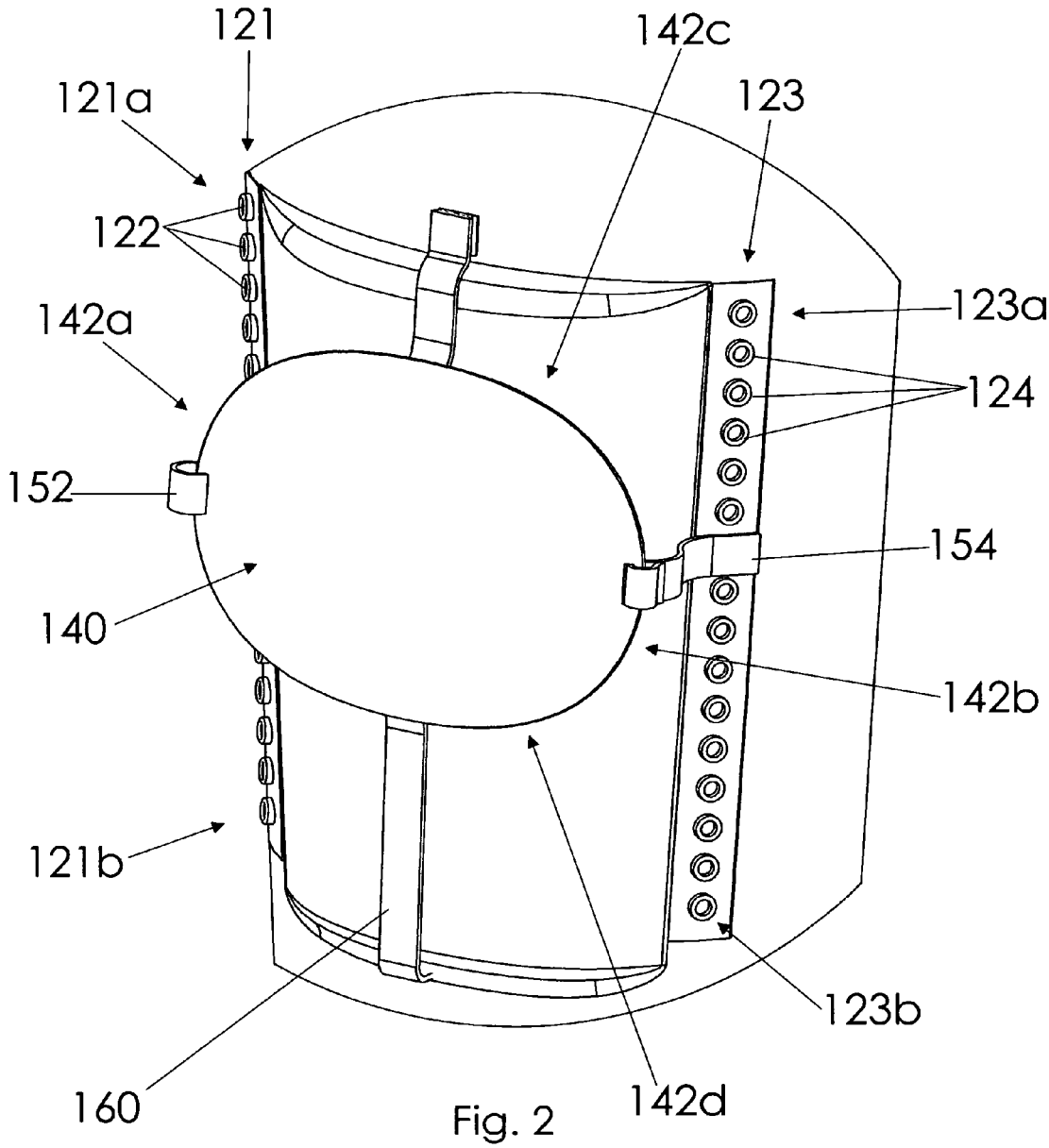
FIG. 2 is an isolated view on an enlarged scale of an adjustable protective member fastened to the trousers shown in FIG. 1.
Figure 6A:
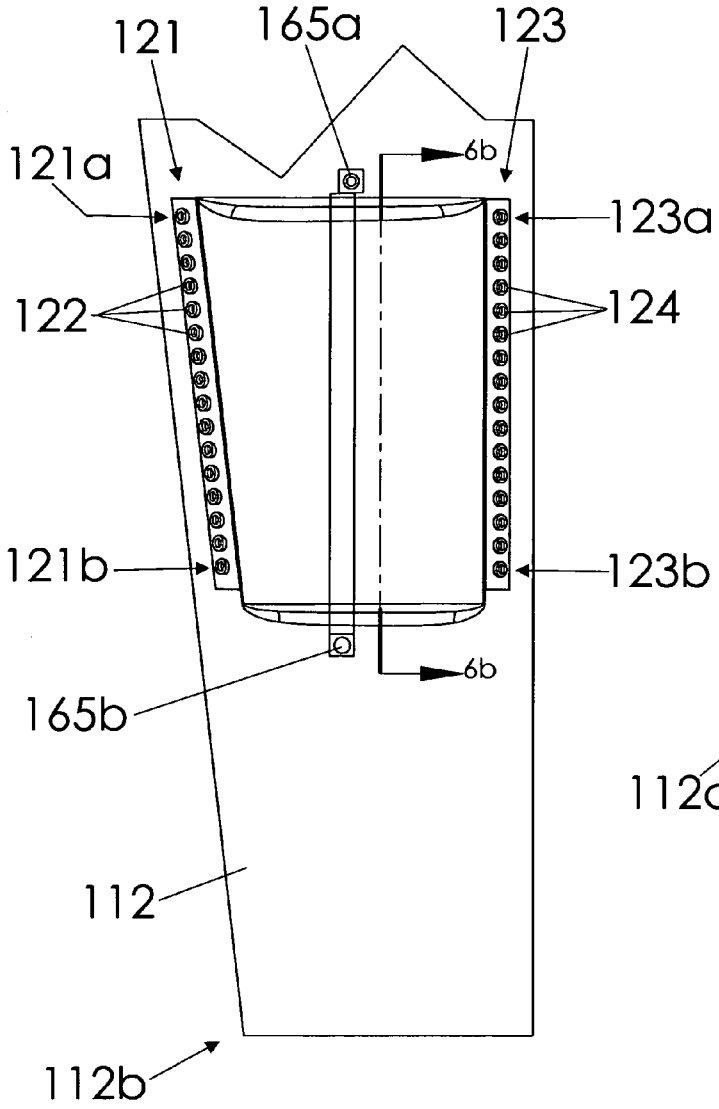
FIG. 6*a* is a fragmentary front view of the trousers in FIG. 1 with the adjustable protective member removed.
Figure 6B:
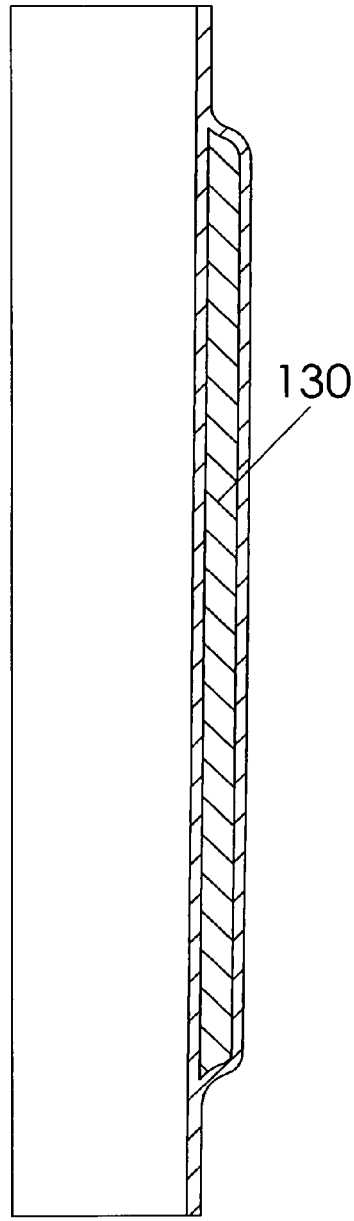
FIG. 6*b* is a sectional view taken along line 6*b*-6*b* of FIG. 6*a.*

As shown in FIG. 2 and FIG. 6*a*, a first array 121 of fasteners 122 and a second array 123 of fasteners 124 are coupled to the leg portion 112. The fasteners 122 and 124 may be the same type or different types of fasteners, such as, for example, snaps, buttons, hook and loop fasteners, and buckles. The first array 121 has an upper end 121*a* relatively adjacent to the leg portion proximal end 112*a* and a lower end 121*b* relatively distant to the leg portion proximal end 112*a*. In other words, between the array upper end 121*a* and the array lower end 121*b*, the array upper end 121*a* is closer to the leg portion proximal end 112*a* and the array lower end 121*b* is closer to the leg portion distal end 112*b*. Similarly, the second array 123 has an upper end 123*a* relatively adjacent to the leg portion proximal end 112*a* and a lower end 123*b* relatively distant to the leg portion proximal end 112*a*. In other words, between the array upper end 123*a* and the array lower end 123*b*, the array upper end 123*a* is closer to the leg portion proximal end 112*a* and the array lower end 123*b* is closer to the leg portion distal end 112*b*. The first and second arrays 121, 123 are generally linear arrays in some embodiments.

The adjustable protective member 140, as shown in FIG. 2 through FIG. 5, has first and second sides 142*a*, 142*b* and upper and lower ends 142*c*, 142*d* and may be completely separable from the leg portion 112. The adjustable protective member 140 is sized and configured to cover a wearer's kneecap and includes a rigid shell that may be constructed, for example, of hard plastic, metal, and/or other appropriate materials.

Figure 3:
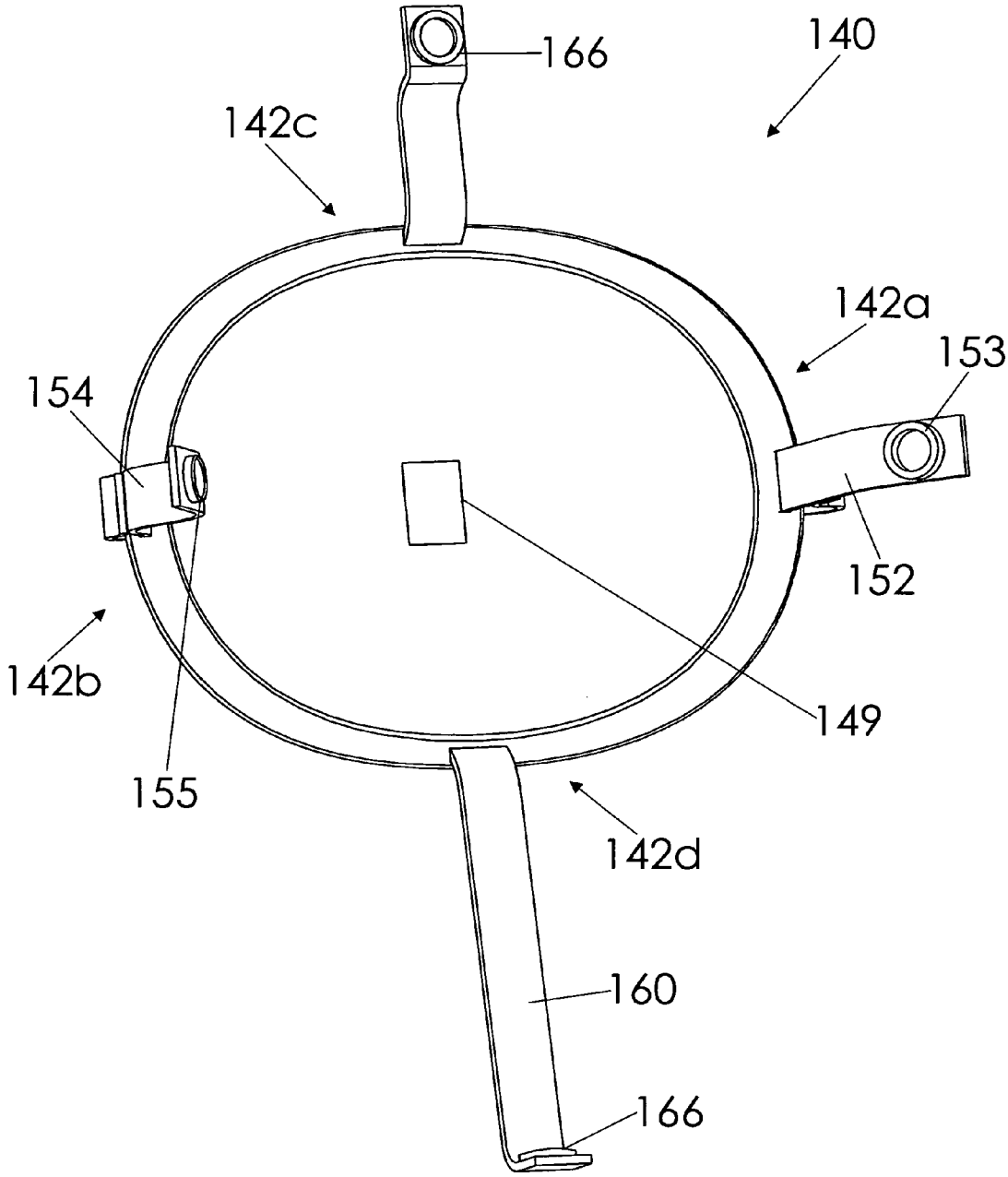
FIG. 3 is a rear view of the adjustable protective member removed from the trousers as in FIG. 2.
Figure 4A:
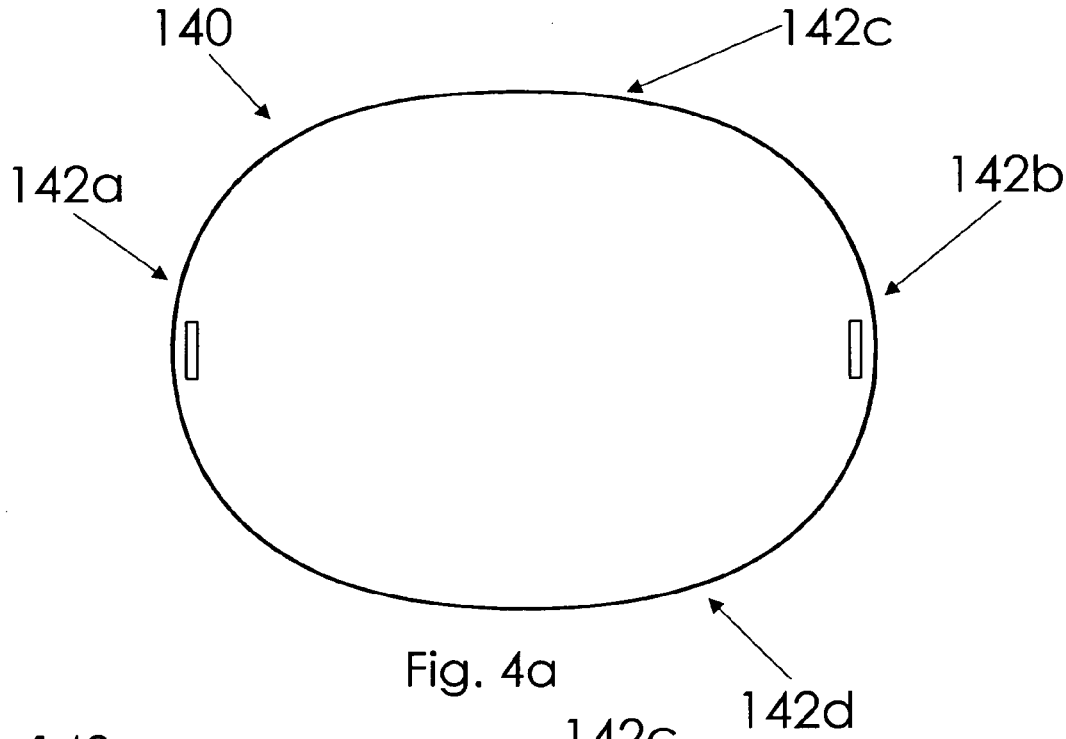
FIG. 4*a* is a front view of the adjustable protective member as in FIG. 2 removed from the trousers and having the straps removed.
Figure 4B:
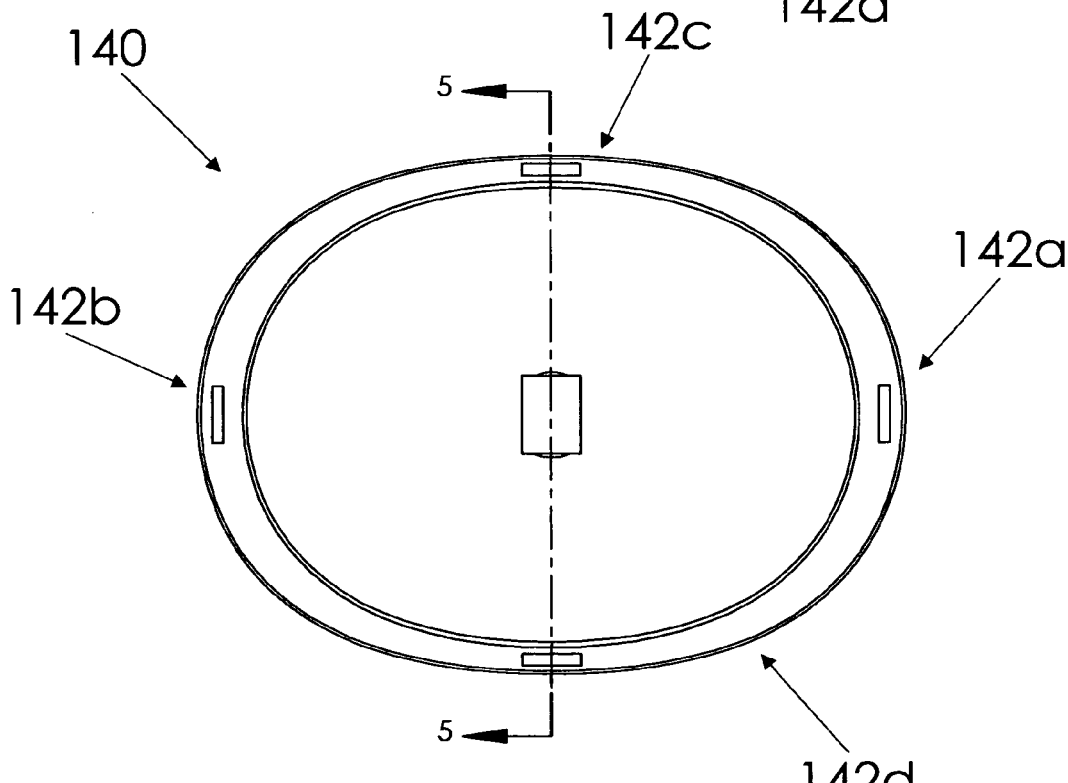
FIG. 4*b* is a rear view of the adjustable protective member as in FIG. 4*a;*
Figure 5:
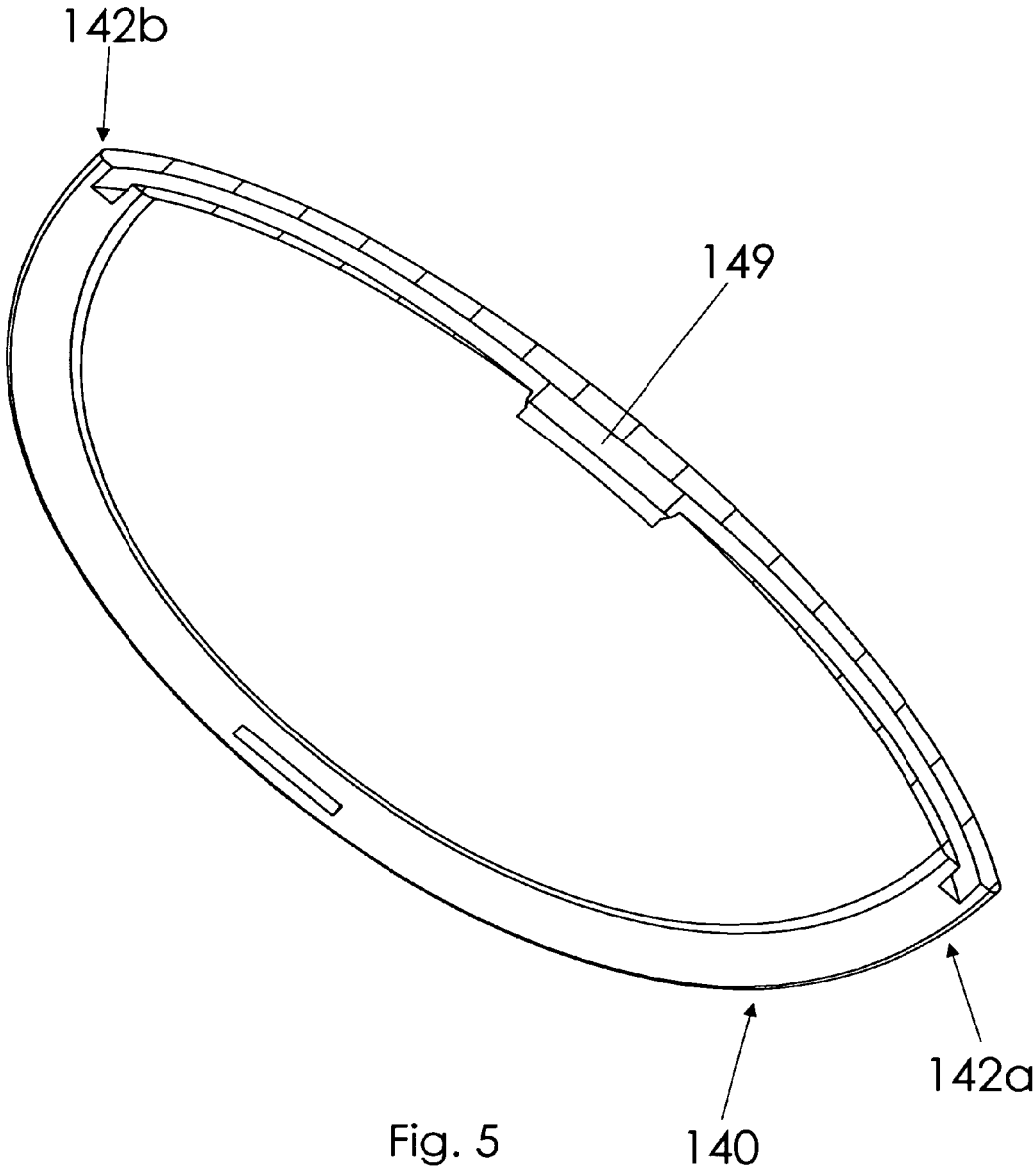
FIG. 5 is a sectional view taken along line 5-5 of FIG. 4*b;*

Means are included for removably coupling the first and second sides 142*a*, 142*b* to the fasteners 122, 124 in the first and second arrays 121, 123 such that utilizing fasteners 122, 124 relatively adjacent the upper ends 121*a*, 123*a* causes the adjustable protective member to be closer to the leg portion proximal end 112*a* than when fasteners 122, 124 relatively more distal to the upper ends 121*a*, 123*a* are utilized. For example, as shown in FIG. 2 and FIG. 3, a first strap 152 may extend from the adjustable protective member first side 142*a* and a second strap 154 may extend from the adjustable protective member second side 142*b*. The first strap 152 may include a fastener 153 complementary to the fasteners 122 to removably couple the first strap 152 to the respective fasteners 122 in the first array 121, and the second strap 154 may include a fastener 155 complementary to the fasteners 124 to removably couple the second strap 154 to the respective fasteners 124 in the second array 123. Coupling the first and second straps 152, 154 to the fasteners 122, 124 in the first and second arrays 121, 123 relatively adjacent the array upper ends 121*a*, 123*a* causes the adjustable protective member 140 to be relatively adjacent the leg portion proximal end 112*a*, and coupling the first and second straps 152, 154 to the fasteners 122, 124 in the first and second arrays 121, 123 relatively adjacent the array lower ends 121*b*, 123*b* causes the adjustable protective member 140 to be relatively adjacent the leg portion distal end 112*b*. The first strap 152 may be separate from the second strap 154, as shown in FIG. 3.

Means may also be included for maintaining the adjustable protective member 140 at a desired location between the first and second arrays 121, 123 of fasteners 122, 124. For example, a strap 160 (FIG. 1 through FIG. 3) may extend along the leg portion 112 between the first and second arrays 121, 123 of fasteners 122, 124, and the strap 160 may interact with the adjustable protective member 140 to maintain the adjustable protective member 140 at a desired location between the first and second arrays 121, 123 of fasteners 122, 124. In some embodiments, the strap 160 may be permanently coupled to the leg portion 112 and the protective member 140 may removably clip to the strap 160. In other embodiments, as shown in FIG. 3 and FIG. 6*a*, for example, an upper fastener 165*a* may be coupled to the leg portion 112 between the first and second arrays 121, 123 of fasteners 122, 124 (e.g., adjacent the array upper ends 121*a*, 123*a*), a lower fastener 165*b* may be coupled to the leg portion 112 between the first and second arrays 121, 123 of fasteners 122, 124 (e.g., adjacent the array lower ends 121*b*, 123*b*), and the strap 160 may include fasteners 166 to couple the strap 160 to the upper and lower fasteners 165*a*, 165*b*. The strap 160 extends upwardly from the upper end 142*c* of the adjustable protective member 140 and downwardly from the lower end 142*d* of the adjustable protective member 140 and may be a single strap (as shown) or two separate straps. If a single strap, strap 160 may pass through at least one clip 149 in the adjustable protective member, as shown in FIG. 3.

In use, the user wears the trousers 110. The padding 130 provides protection and comfort to the user's knee when the user is positioned on his knee. The adjustable protective member 140 is attached to the trousers 110 using the straps 152, 154, and the fasteners 153, 155 on the straps 152, 154 are coupled to the fasteners 122, 124 in the arrays 121, 123 such that the adjustable protective member 140 is located adjacent the user's knee cap. The strap 160 maintains the adjustable protective member 140 between the arrays 121, 123 of fasteners 122, 124 such that it is correctly positioned side-to-side adjacent the user's knee cap. Once attached, the adjustable protective member 140 may provide additional protection and comfort to the user's knee when the user is positioned on his knee. The adjustable protective member 140 may be removed, such as when the trousers 110 are being laundered, and may be utilized with additional pairs of trousers 110.

It is understood that while certain forms of this invention have been illustrated and described, it is not limited thereto except insofar as such limitations are included in the following claims and allowable functional equivalents thereof.

The invention claimed is:

1. Protective clothing, comprising:

trousers having a leg portion with a distal end, a proximal end, and a knee area that corresponds to a wearer's knee when said trousers are worn by said wearer;

padding coupled to said trousers and extending adjacent said knee area;

a first array of fasteners coupled to said leg portion, said first array having an upper end relatively adjacent to said leg portion proximal end and a lower end relatively distant to said leg portion proximal end;

a second array of fasteners coupled to said leg portion, said second array having an upper end relatively adjacent to said leg potion proximal end and a lower end relatively distant to said leg portion proximal end;

an adjustable protective member having a first side and a second side, said adjustable protective member having upper and lower ends;

means for removably coupling said adjustable protective member first side to said fasteners in said first array and means for removably coupling said adjustable protective member second side to said fasteners in said second array, coupling to said fasteners in said first and second arrays relatively adjacent said upper ends causing said adjustable protective member to be relatively adjacent said leg portion proximal end, coupling to said fasteners in said first and second arrays relatively adjacent said lower ends causing said adjustable protective member to be relatively adjacent said leg portion distal end;

an upper fastener coupled to said leg portion between said first and second arrays of fasteners;

a lower fastener coupled to said leg portion between said first and second arrays of fasteners;

an upper strap extending from said adjustable protective member upper end, said upper strap being selectively coupled to said upper fastener;

a lower strap extending from said adjustable protective member lower end, said lower strap being selectively coupled to said lower fastener;

wherein:

a single strap defines said upper strap and said lower strap;

said single strap passes through at least one clip in said adjustable protective member;

said adjustable protective member includes a rigid shell;

said padding includes closed cell foam;

said first array is a generally linear array; and said second array is a generally linear array.

2. The clothing of claim 1, wherein said adjustable protective member includes a rigid shell.

3. The clothing of claim 2, wherein said padding includes closed cell foam.

4. The clothing of claim 3, wherein said first array is a generally linear array and said second array is a generally linear array.

5. The clothing of claim 4, further comprising means for maintaining said adjustable protective member at a desired location between said first and second arrays of fasteners.

6. The clothing of claim 1, further comprising at least one strap extending along said leg portion between said first and second arrays of fasteners, said at least one strap interacting with said adjustable protective member to maintain said adjustable protective member at a desired location between said first and second arrays of fasteners.

7. Protective clothing, comprising:

trousers having a leg portion with a distal end, a proximal end, and a knee area that corresponds to a wearer's knee when said trousers are worn by said wearer;

padding coupled to said trousers and extending adjacent said knee area;

a first array of fasteners coupled to said leg portion, said first array having an upper end relatively adjacent to said leg portion proximal end and a lower end relatively distant to said leg portion proximal end;

a second array of fasteners coupled to said leg portion, said second array having an upper end relatively adjacent to said leg potion proximal end and a lower end relatively distant to said leg portion proximal end;

an adjustable protective member having a first side and a second side, said adjustable protective member having upper and lower ends;

a first strap extending from said adjustable protective member first side and having a fastener to removably couple said first strap to said fasteners in said first array; and a second strap extending from said adjustable protective member second side and having a fastener to removably couple said second strap to said fasteners in said second array;

wherein coupling said first and second straps to said fasteners in said first and second arrays relatively adjacent said upper ends causes said adjustable protective member to be relatively adjacent said leg portion proximal end, and coupling said first and second straps to said fasteners in said first and second arrays relatively adjacent said lower ends causes said adjustable protective member to be relatively adjacent said leg portion distal end an upper fastener coupled to said leg portion between said first and second arrays of fasteners;

a lower fastener coupled to said leg portion between said first and second arrays of fasteners;

an upper strap extending from said adjustable protective member upper end, said upper strap being selectively coupled to said upper fastener;

a lower strap extending from said adjustable protective member lower end, said lower strap being selectively coupled to said lower fastener;

wherein:

a single strap defines said upper strap and said lower strap;

said single strap passes through at least one clip in said adjustable protective member; and said first strap is separate from said second strap.

8. The clothing of claim 7, wherein said adjustable protective member includes a rigid shell.

9. The clothing of claim 8, wherein said padding includes closed cell foam.

10. The clothing of claim 9, wherein said first array is a generally linear array and said second array is a generally linear array.

11. The clothing of claim 10, further comprising means for maintaining said adjustable protective member at a desired location between said first and second arrays of fasteners.

12. The clothing of claim 7, wherein said adjustable protective member is completely separable from said leg portion.

13. The clothing of claim 12, further comprising at least one strap extending along said leg portion between said first and second arrays of fasteners, said at least one strap interacting with said adjustable protective member to maintain said adjustable protective member at a desired location between said first and second arrays of fasteners.

14. The clothing of claim 7, wherein:

said adjustable protective member includes a rigid shell;

said padding includes closed cell foam;

said first array is a generally linear array; and said second array is a generally linear array.

* * * * *